US005935657A

United States Patent [19]

Melendez

[11] Patent Number: 5,935,657

[45] Date of Patent: Aug. 10, 1999

[54] MULTIPLE NOZZLE PAINT SPRAY APPARATUS AND METHOD FOR PAINTING A SURFACE

[76] Inventor: Henry Melendez, 8538 Creekwood Way, Fair Oaks, Calif. 95628

[21] Appl. No.: 08/977,851

[22] Filed: Nov. 25, 1997

[51] Int. Cl.[6] ..... B05D 1/02; B05C 3/18

[52] U.S. Cl. ..... 427/421; 118/317; 118/315; 118/323; 239/280; 239/280.5; 239/281

[58] Field of Search ..... 239/280, 280.5, 239/281; 118/315, 323, 317; 427/421

[56] References Cited

U.S. PATENT DOCUMENTS

| | | | |
|---|---|---|---|
| 2,572,142 | 10/1951 | Hartenbach, Jr. . | |
| 2,581,678 | 1/1952 | Malin et al. . | |
| 2,605,138 | 7/1952 | Paasche . | |
| 3,061,201 | 10/1962 | Rienecker . | |
| 3,219,276 | 11/1965 | Norris . | |
| 3,237,346 | 3/1966 | Watts . | |
| 3,788,273 | 1/1974 | Tusch et al. . | |
| 4,344,991 | 8/1982 | Gray . | |
| 4,793,559 | 12/1988 | Marlek | 239/722 |
| 5,295,626 | 3/1994 | Mirabito . | |
| 5,494,228 | 2/1996 | Eaton et al. . | |

*Primary Examiner*—Katherine A. Bareford
*Attorney, Agent, or Firm*—John P. O'Banion

[57] ABSTRACT

A multiple nozzle paint spraying system two separate banks of spray nozzles. One of the banks is vertically disposed, and the other bank is adjustable to be positioned either vertically or horizontally, the adjustable bank being positioned above the vertical bank. Both banks are supplied by paint from an airless pressurized source, and each individual bank has a shut-off valve to stop the flow of pressurized paint to that respective bank. The entire assembly is mounted on a rollable stand which has a pair of arms extending laterally outward. Wheels or castors are located at the end of the lateral arms which abut the base board or bottom of the wall being painted. During use, the painter merely activates the paint spray and pushes the apparatus along the wall. The lateral arms maintain the spray nozzles at a fixed distance from the wall, and a coat of paint can applied to the wall uniformly and quickly. When painting a wall, the adjustable bank is positioned vertically and both banks are used. When painting a ceiling, the vertical bank is shut off, and the adjustable bank is positioned horizontally to orient the spray nozzles toward the ceiling.

16 Claims, 4 Drawing Sheets

MULTIPLE NOZZLE PAINT SPRAY APPARATUS AND METHOD FOR PAINTING A SURFACE

BACKGROUND OF THE INVENTION

1. Field of the Invention

This invention pertains generally to paint spraying systems and more particularly to a multiple nozzle paint spraying system mounted on a portable stand.

2. Description of the Background Art

Painting can be extremely labor intensive and costs for a paint job are primarily based on a painter's time to complete the project. Accordingly, it is beneficial to increase a painter's efficiency so as to reduce labor costs.

A conventional approach to paint walls or structures has been to use a paint brush, however this approach can be prohibitively expensive, especially if the structure has a large surface for the painter to paint. The painter has to use many repetitive strokes, and the brush has to be continually rewetted after the paint is applied to the surface. Also, the amount of surface area that can be covered by a stroke of the paint brush is limited to the width of the brush.

Another conventional approach which is an improvement over the paint brush is a paint roller. In all aspects, the paint roller is similar to the paint brush (i.e. repetitive strokes and continual rewetting); however the main advantage the paint roller has over the paint brush is that the roller's width is generally greater than a brush's, thus allowing the painter to cover more surface area in a given stroke. A painter's efficiency when using a paint roller was improved by the addition of a pressurized paint supply feeding directly to the roller mechanism through a tube. The pressurized paint supply eliminated the need to continually rewet the roller, thus saving valuable time; however, the amount of surface area that can be painted with any given stroke is still limited by the width of the roller.

Paint sprayers were developed as an improvement over the pressurized roller as the paint sprayer allows a painter to paint a significantly larger surface area in less time than the pressurized roller. However, the disadvantage that became apparent with the paint sprayer was that a less than uniform coat of paint is often applied to the surface at any single pass by the sprayer. The painter has to hold the spray nozzle, aim it at the surface to be painted, and physically move the spray nozzle along the surface, usually back and forth vertically or horizontally. If the painter varies the pace at which the spray nozzle moves across the surface, varies the distance of the nozzle from the surface or varies the angle of the nozzle relative to the surface, a non-uniform coat of paint usually results. This would require the painter to spray the surface with another coat until a uniform coat is achieved. In addition to wasting time, this repetitive process also wastes paint, and unnecessarily adds to the expense of completing the project.

Accordingly, there is a need for a paint spraying system that allows a painter to work more efficiently by applying paint quickly and uniformly, thereby allowing the painter to save time, effort and paint. The present invention satisfies those needs, as well as others, and generally overcomes the deficiencies found in the background art.

BRIEF SUMMARY OF THE INVENTION

The foregoing needs are satisfied by a rollable multiple nozzle paint sprayer in accordance with the present invention that is adapted to quickly paint a wall and/or ceiling without having to be held by the painter. In general terms, the invention comprises a plurality of spray nozzles mounted on two individual linear-shaped banks, a paint supply means, a rollable stand and a pair of arms extending laterally from the stand.

One of the banks is vertically disposed and the other bank is adjustable for either a horizontal or vertical position by a swivel. The vertical bank sprays paint in a horizontal direction. The nozzles are located at evenly-spaced intervals across each bank. The paint supply means supplies pressurized paint to each bank, which distributes the paint to each individual nozzle. A flow control nozzle regulates the flow of paint to each bank, and each bank has a shutoff valve to stop the flow of paint. A flow brake is located behind each nozzle, thus preventing paint from spurting after the pressurized paint source has been shut off. The entire assembly is attached to the stand.

When painting a wall, the lateral arms abut the baseboard or bottom of the wall, and maintain the spray nozzles a uniform fixed distance from the wall. The unit is pushed along the wall from side to side while the nozzles are spraying the paint, thus allowing the entire wall to be painted very quickly, efficiently and uniformly. Both banks are used and the adjustable bank is adjusted vertically such that the paint is sprayed in a horizontal direction. When painting a ceiling, the vertical (lower) bank is shut off, and the adjustable bank is positioned in a horizontal position such that the paint sprays vertically upwards. The unit is pushed along from one end of the ceiling to the other until the entire ceiling has been painted.

An object of the invention is to provide a means to paint a large surface area using a paint spray system with multiple spray nozzle capability.

Another object of the invention is to provide a means to paint a large surface using a paint spray system with only a single pass of the system.

Another object of the invention is to provide a means to paint a surface using a paint spray system that maintains the system at a uniform fixed distance from the surface.

Another object of the invention is to provide a means to paint a surface which minimizes the labor time expended by the painter.

Yet another object of the invention is to provide a means to paint a surface which minimizes the amount of paint required.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 5. It will be appreciated that the apparatus may vary as to configuration and as to details of the parts without departing from the basic concepts as disclosed herein.

Figure 1:
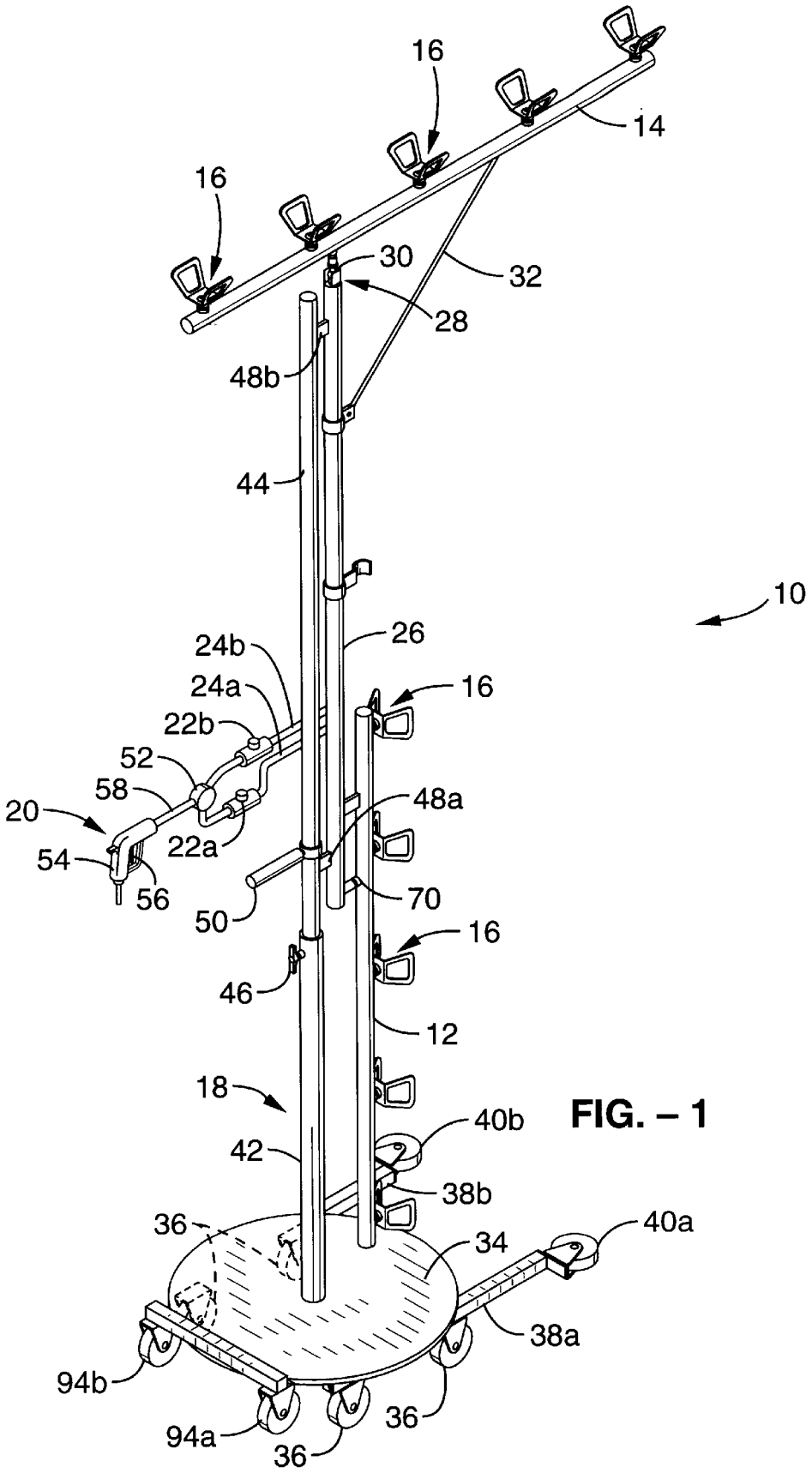
FIG. 1 is a perspective view of a multiple nozzle paint spray apparatus in accordance with the present invention.

Referring first to FIG. 1, a multiple nozzle paint spray apparatus 10 in accordance with the present invention is generally shown. As will be seen, the apparatus 10 generally comprises a vertically disposed nozzle support member 12, an adjustable nozzle support member 14, a plurality of paint spray nozzles 16, a rollable stand assembly 18, a flow control valve 20, a pair of shutoff valves 22*a*, 22*b* and associated tubing 24*a*, 24*b*.

Spray nozzles 16 are attached linearly at evenly-spaced intervals along nozzle support member 12 and along nozzle support member 14 such that the nozzles 16 spray in a direction perpendicular to their respective nozzle support members. In this way, two banks of nozzles are formed. Nozzle support member 14 is attached to the top end 28 of a branch support rod 26 by a swivel fitting 30 or the like, thereby allowing adjustability of nozzle support member 14 between a vertical and horizontal position. A support arm 32 pivotally mounted on branch support rod 26 provides further support to nozzle support member 14 when nozzle support member 14 is oriented in the horizontal position, such as shown in FIG. 1. The vertically disposed nozzle support member 12 on the other hand is fixedly attached to branch support rod 26.

Stand assembly 18 includes a base 34, beneath which swivel wheels or castors 36 are mounted, thereby rendering the base rollable. A pair of guide legs 38*a*, 38*b* extend laterally from the base and are generally parallel to each other. Horizontally mounted wheels 40*a*, 40*b* are located at the distal ends of each of legs 38*a*, 38*b*, respectively. Also extending from base 34 is a lower shaft 42, to which an upper shaft 44 is telescopically mated. Upper shaft 44 is vertically adjustable relative to lower shaft 42 and can be locked in place by a threaded knob 46 to set the desired vertical position. Branch support rod 26 is fixedly fastened to upper shaft 44 by couplers 48*a*, 48*b*. A handle 50 is attached to upper shaft 44 at a level where a painter can use the handle to push the apparatus 10.

Figure 2:
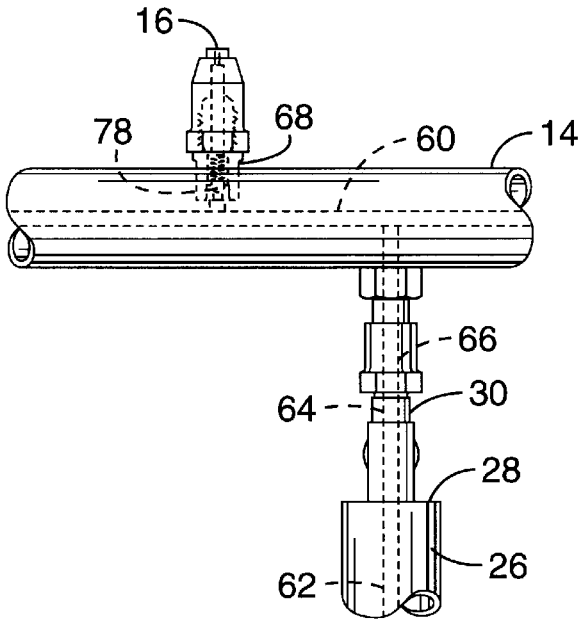
FIG. 2 is a partial detailed view of the section of the apparatus indicated in FIG. 5.
Figure 5:
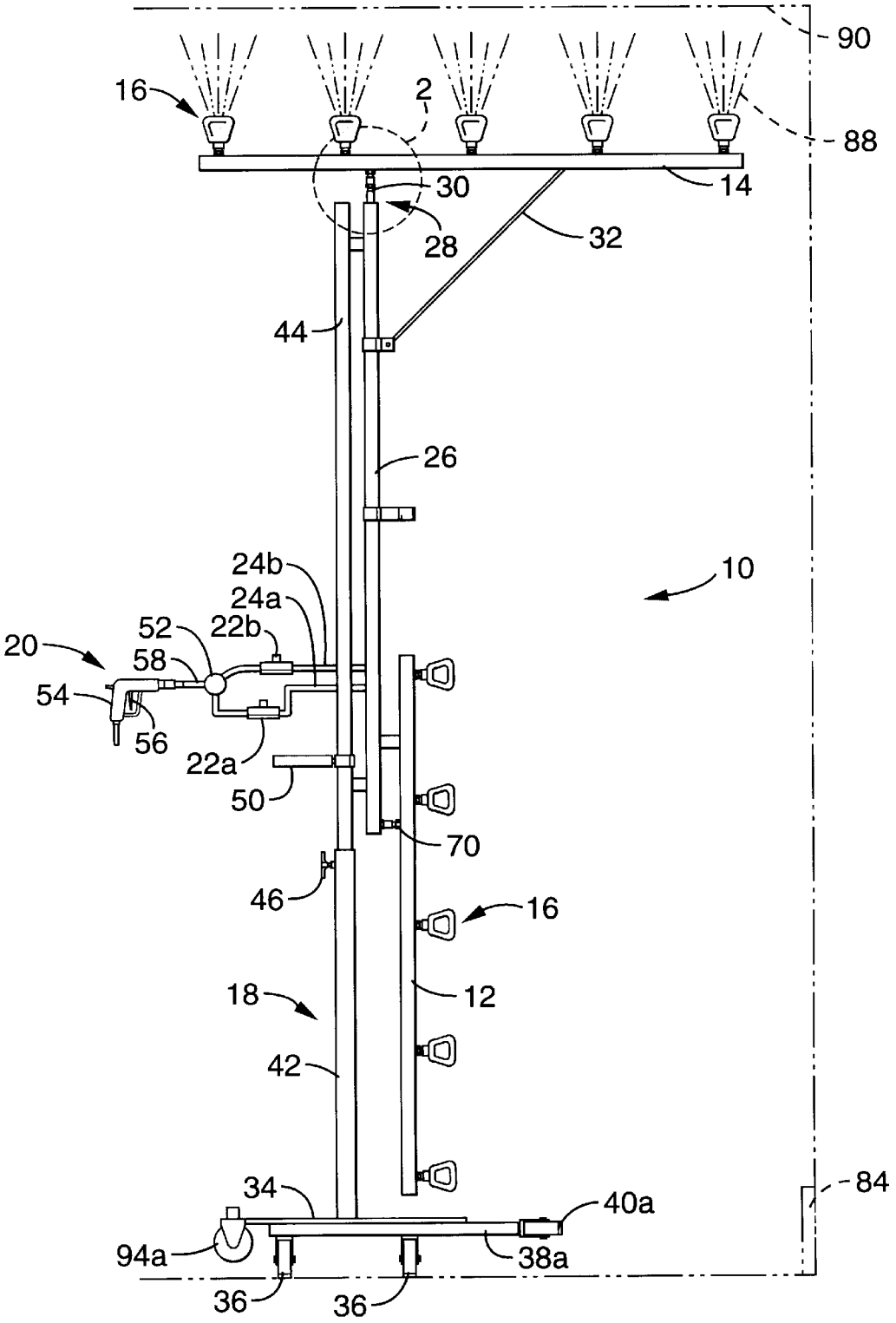
FIG. 5 is a side view of the apparatus shown in FIG. 1 configured to paint a ceiling.

Tubing 24*a*, 24*b* routes paint from a pressurized paint supply (not shown) to the nozzles 16 via branch support rod 26 and nozzle support members 24*a*, 24*b*, respectively. Paint supplied to nozzles 16 is pressurized by any of the commonly known methods, an example of which is a pump or compressor (not shown) that is fluidly connected to a paint supply, and is therefore not discussed in further detail. Shut off valves 22*a*, 22*b* allow individual control of paint flow to each nozzle support member 12, 14, respectively, thereby allowing the nozzles along nozzle support member 14 to spray paint while paint flow to the nozzles along vertically disposed nozzle support member 12 is shut off. Tubing 24*a*, 24*b* are connected to flow control valve 20 by a tee connector 52. Flow control valve 20 regulates the flow of paint from the paint supply to nozzles 16. Flow control valve 20 has a grip 54 and trigger mechanism 56 by which the painter can initiate and stop the flow of paint. Flow control valve 20 is attached to the tee connector 52 by a hose 58. Flow control valve 20 is in turn connected to a paint supply (not shown). Referring also to FIG. 2 and FIG. 5, nozzle support member 14 has a hollow tube 60 within which serves as a feeder to nozzles 16. Branch support rod 26 has a hollow tube 62 which is in fluid connection with tubing 24*b*. Swivel fitting 30 has a bore 64 which accommodates a flexible tube 66 passed therethrough that fluidly connects tube 60 to tube 62.

A plurality of flow brakes 68 are provided to prevent paint from spurting out from the spray nozzles 16 immediately after flow control valve 20 is shut off. Because considerable pressure is built up within tubes 60, 62 and 66, paint would otherwise spurt from nozzles 16 even after flow control valve 20 has been shut off. This is due to the depletion of residual pressure in tubes 60, 62 and 66 after flow control valve 20 has been shut off.

The internal construction of nozzle support member 12 is essentially identical to that shown for nozzle support member 14, with the exception of a rigid fitting 70 in instead of the swivel fitting 30 and that the nozzles along nozzle support member 12 are fluidly coupled to tubing 24*a*. It will also be appreciated that instead of routing tubing through the support members to the nozzles attached thereto, the nozzle support members can be hollow tubes, sealed at each end, that carry the paint directly to the nozzles.

Figure 3A:
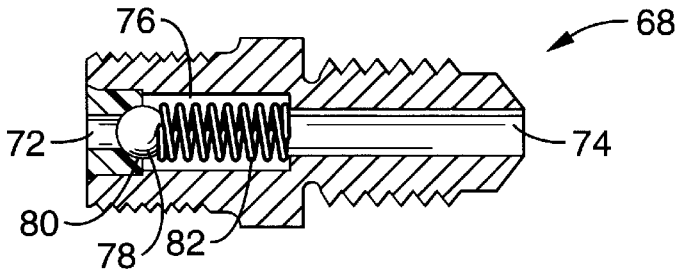
FIG. 3A and FIG. 3B are cross-sectional views of a flow brake employed in the present invention, shown in the closed and open positions, respectively.
Figure 3B:
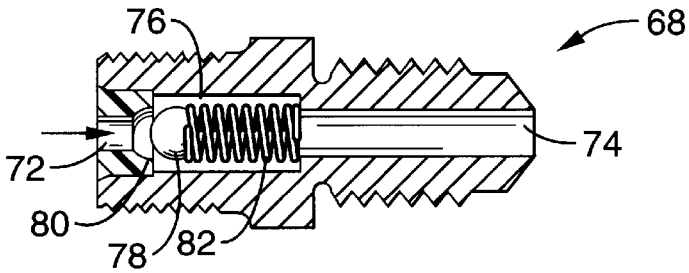

Referring also to FIG. 3A and FIG. 3B, each flow brake 68 comprises a threaded fitting with an inlet port 72 and an outlet port 74. The inlet end is screwed into a nozzle support member and the outlet end is screwed into a spray nozzle 16. Internally, flow brake 68 has a bore 76 that extends between inlet port 72 and outlet port 74 such that paint can flow from inlet port 72 to outlet port 74. A ball valve 78 fits within bore 76 and seats against an internal flange 80 under biasing from a spring 82 as shown in FIG. 3A. In this position, ball valve 78 prevents paint from flowing through flow brake 68. When flow control valve 20 is activated, paint pressure displaces ball valve 78 away from the flange 80, thereby allowing paint to flow through flow brake 68, as shown in FIG. 3B. When flow control valve 20 is shut off, spring 82 instantaneously biases ball valve 78 back against the flange 80, thus shutting off the paint flow and prohibiting paint from spurting out nozzles 16.

Figure 4:
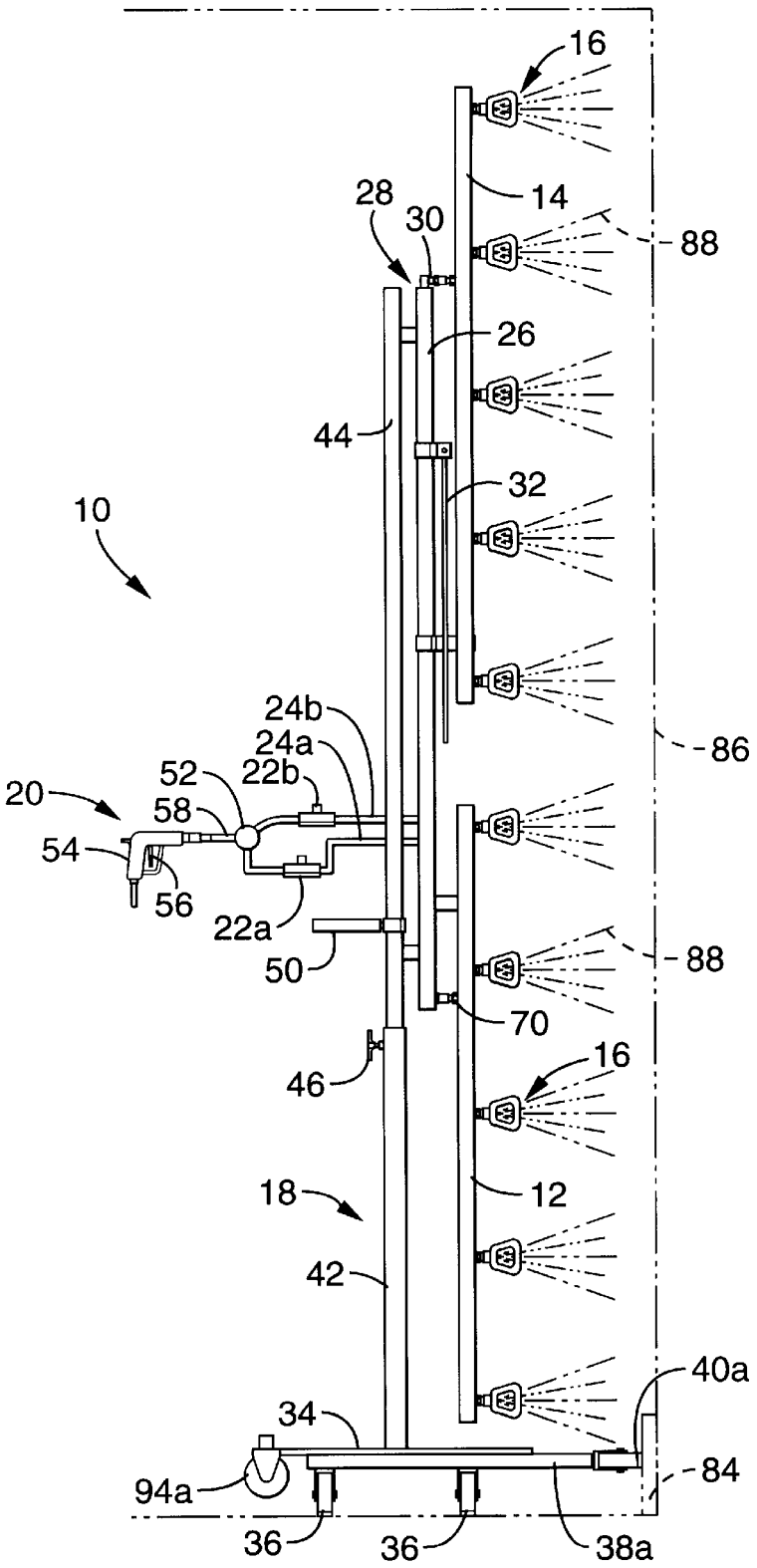
FIG. 4 is a side view of the apparatus shown in FIG. 1 configured to paint a wall.

FIG. 4 illustrates the apparatus 10 with the lateral legs 38*a* and 38*b* (not shown) abutting the bottom or baseboard 84 of a wall 86 in preparation for painting the wall. Horizontal wheels 40*a* and 40*b* (not shown) attached to the distal ends of legs 38*a*, 38*b* allow the apparatus 10 to easily move along wall 86 as the apparatus 10 is pushed. The combination of lateral legs 38*a*, 38*b* and horizontal wheels 40*a*, 40*b* abutting the bottom or baseboard 84 of the wall 86 serve to maintain the nozzles 16 at a uniform and fixed distance from the wall 86 that is being painted, thereby assuring that an even and consistent layer of paint 88 is applied to wall 86. Wheels or castors 36 at the bottom of base 34 allow base 34 to roll along the side of the when the apparatus 10 is pushed.

To paint a wall 86, the painter positions nozzle support member 14 so that it is vertically disposed, as shown in FIG. 4. Once in this position, both nozzle support member 12 and nozzle support member 24 can spray paint 88 horizontally towards wall 86. In use, apparatus 10 is positioned at one end of wall 86 with horizontal wheels 40*a*, 40*b* abutting against the bottom or baseboard 84 of wall 86. A paint supply (not shown) is then attached to the flow control valve 20, if not already attached. The painter initiates the flow of paint to the nozzles using the trigger 56 on the flow control valve 20. Both shutoff valves 22*a*, 22*b* must be open for paint to flow from the paint supply to the nozzles 16. When paint 88 begins spraying from the nozzles 16, the painter pushes the apparatus 10 alongside the wall 86 until the apparatus 10 reaches the other end of the wall 86. When the apparatus 10 reaches the other end of the wall 86, the painter releases the trigger 56 on the flow control valve 20, thereby stopping the paint spray 88 from the nozzles 16. To paint another wall, the painter merely repeats the foregoing steps. Using the apparatus 10 and method disclosed to paint a wall, one can obviously see that a painter can paint the entire surface of a wall with a single pass using the apparatus 10.

The apparatus can also be adapted to paint a ceiling 90, as shown in FIG. 5. To paint a ceiling 90, the painter positions nozzle support member 14 in a horizontal position such that the nozzles 16 are oriented to spray paint 88 upwards. Shutoff valve 22*b*, which supplies paint to the nozzles along nozzle support member 14, is open, but shutoff valve 22*a*, which supplies paint to nozzle support member 12, is closed, as only the nozzles along nozzle support member 14 are used in this application. A paint supply (not shown) is then attached to flow control valve 20, if not already attached. The painter then positions the apparatus 10 so that nozzles 16 will begin to spray paint 88 at one end of ceiling 90. The painter initiates the flow of paint to nozzles 16 using trigger 56 on flow control valve 20. When paint begins spraying from nozzles 16, the painter pushes the apparatus 10 across to the other end of ceiling 90. Once paint has been sprayed across to the other end of ceiling 90, the painter releases trigger 56 on flow control valve 20 and stops the paint spray 88 from nozzles 16. The painter then repositions the apparatus 10 to begin another spray pass across ceiling 90. Since nozzles 16 are maintained at a uniform and fixed distance from ceiling 90 as the apparatus 10 is moved across ceiling 90, an even and consistent layer of paint is applied to ceiling 90 on a given pass of the apparatus 10. Because only one bank of nozzles is used when painting a ceiling 90, and ceiling widths are generally much wider than the width of sprayed paint's path, multiple passes are required by the painter to complete a ceiling 90. Auxiliary wheels 94*a* and 94*b* (not shown) allow for tilting the apparatus 10 such that the apparatus 10 can be moved through areas having low vertical clearances or to allow the apparatus 10 to be rolled rapidly to and from a work site.

Accordingly, it can be seen that the present invention can paint a wall or ceiling in a very short amount of time by using multiple spray paint nozzles moved along the surface at a uniform, fixed distance, thus minimizing the labor expended by a painter. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A method of painting a wall using a multiple nozzle paint spray apparatus, wherein said apparatus comprises:

a first plurality of paint spray nozzles linearly positioned along a first support member that is oriented vertically;

a second plurality of paint spray nozzles linearly positioned along a second support member that is adjustable between a vertical orientation and a horizontal orientation;

paint supplying means for supplying paint to each said nozzle, wherein the flow of paint to the nozzles along said first support member is controllable independently of the flow of paint to the nozzles along said second support member;

a rollable support stand, said stand supporting said first and second support members and said paint supplying means;

a plurality of arms, said arms extending laterally from said stand; and a plurality of flow brakes, a said one of said flow brakes placed in series between each said nozzle and said paint supply means; and wherein said method comprises the steps of:

positioning said second support member in a substantially vertical position;

positioning said arms to abut said wall;

attaching a paint supply to said painting means;

activating said paint supplying means such that paint sprays from said first and second plurality of nozzles; and pushing said rollable stand along said wall while maintaining said arms abutted against said wall such that paint is sprayed in a path across said wall.

2. A method of using a multiple nozzle paint spray apparatus, wherein said apparatus comprises:

a first plurality of paint spray nozzles linearly positioned along a first support member that is oriented vertically;

a second plurality of paint spray nozzles linearly positioned along a second support member that is adjustable between a vertical orientation and a horizontal orientation;

paint supplying means for supplying paint to each said nozzle, said paint supply means comprising first and second tubing, said first tubing connected to and in fluid connection with said nozzles positioned along said first support member, said second tubing connected to and in fluid connection with said nozzles positioned along said second support member, a tee connector, said tee connector in fluid connection with said first tubing and said second tubing, a flow control valve in fluid connection with said tee connector, said flow control valve including means for attachment to a paint supply, and a pair of shut-off valves, first said shut-off valve located between said tee connector and said nozzles positioned along said first support member, second said shut-off valve located between said tee connector and said nozzles positioned along said second support member, wherein the flow of paint to the nozzles along said first support member is controllable independently of the flow of paint to the nozzles along said second support member;

a rollable support stand, said stand supporting said first and second support members and said paint supplying means;

a plurality of arms, said arms extending laterally from said stand; and a plurality of flow brakes, a said one of said flow brakes placed in series between each said nozzle and said paint supply means; and wherein said method comprises the steps of:

positioning said second support member in a substantially horizontal position;

positioning said arms to abut a wall adjacent to said ceiling;

attaching a paint supply to said flow control valve;

ensuring said first shutoff valve is shut;

activating said flow control valve such that paint sprays from said second plurality of nozzles; and pushing said rollable stand such that paint is sprayed in a path across said ceiling.

3. A method of painting a wall using a multiple nozzle paint spray apparatus, wherein said apparatus comprises:

a first plurality of spray nozzles positioned linearly along a first support member that is oriented vertically;

a second plurality of spray nozzles positioned linearly along a second support member that is adjustable between a vertical orientation and a horizontal orientation;

a plurality of flow brakes, each said flow brake positioned in series with a corresponding spray nozzle;

paint supplying means for supplying paint to said nozzles, said flow brakes positioned between said nozzles and said paint supplying means, said paint supplying means including branch flow control means for independently controlling the flow of paint to said nozzles along said first support member and said nozzles along said second support member, respectively;

a rollable support stand supporting said first and second support members and said paint supplying means; and a plurality of arms, said arms extending laterally from said stand; and wherein said method comprises the steps of:

positioning said second support member in a substantially vertical position;

placing said arms to abut said wall;

attaching a paint supply to said paint supply means;

activating said paint supply means such that paint sprays from said first and second plurality of nozzles; and pushing said rollable stand along said wall while maintaining said arms abutted to said wall such that paint is sprayed in a path across said wall.

4. A method of painting a ceiling using a multiple nozzle paint spray apparatus, wherein said apparatus comprises:

a first plurality of spray nozzles positioned linearly along a first support member that is oriented vertically;

a second plurality of spray nozzles positioned linearly along a second support member that is adjustable between a vertical orientation and a horizontal orientation;

a plurality of flow brakes, each said flow brake positioned in series with a corresponding spray nozzle;

paint supplying means for supplying paint to said nozzles, said flow brakes positioned between said nozzles and said paint supplying means, said paint supplying means including branch flow control means for independently controlling the flow of paint to said nozzles along said first support member and said nozzles along said second support member, respectively;

said branch flow control means comprising first and second shut-off valves, said first shut-off valve located between said tee connector and said nozzles along said first support member, said second shut-off valve located between said tee connector and said nozzles along said second support member;

a rollable support stand supporting said first and second support members and said paint supplying means; and a plurality of arms, said arms extending laterally from said stand; and wherein said method comprises the steps of:

positioning said second support member in a substantially horizontal position;

positioning said arms to abut a wall adjacent said ceiling;

attaching a paint supply to said flow control valve;

closing said first shutoff valve;

activating said flow control valve such that paint sprays from said second plurality of nozzles; and pushing said rollable stand such that paint is sprayed in a path across said ceiling.

5. A method of painting a wall using a multiple nozzle paint spray apparatus, wherein said apparatus comprises:

a fixed position, vertically oriented linear bank of spray nozzles, a first tubing connected to and in fluid connection with said fixed bank of spray nozzles, and a first shutoff valve in fluid connection with said first tubing;

a linear bank of spray nozzles adjustable between a vertical orientation and a horizontal orientation, a second tubing connected to and in fluid connection with said adjustable bank of spray nozzles, a second shutoff valve in fluid connection with said second tubing;

said banks of spray nozzles supported by a rollable support stand;

a plurality of flow brakes, said flow brakes placed in series between each said nozzle and said corresponding tubing;

a tee connector, said tee connector in fluid connection with said first and second tubing;

a flow control valve in fluid connection with said tee connector, said flow control nozzle including means for attaching to a paint supply; and a plurality of arms, said arms extending laterally from said stand; and wherein said method comprises the steps of:

positioning said adjustable bank of nozzles in a substantially vertical position;

positioning said arms to abut said wall;

attaching a paint supply to said flow control valve;

activating said flow control valve such that paint sprays from said first and second banks of nozzles; and pushing said rollable stand along said wall while maintaining said arms abutted to said wall such that paint is sprayed in a path across said wall.

6. A method of painting a ceiling using a multiple nozzle paint spray apparatus, wherein said apparatus comprises:

a fixed position, vertically oriented linear bank of spray nozzles, a first tubing connected to and in fluid connection with said fixed bank of spray nozzles, and a first shutoff valve in fluid connection with said first tubing;

a linear bank of spray nozzles adjustable between a vertical orientation and a horizontal orientation, a second tubing connected to and in fluid connection with said adjustable bank of spray nozzles, a second shutoff valve in fluid connection with said second tubing;

said banks of spray nozzles supported by a rollable support stand;

a plurality of flow brakes, said flow brakes placed in series between each said nozzle and said corresponding tubing;

a tee connector, said tee connector in fluid connection with said first and second tubing;

a flow control valve in fluid connection with said tee connector, said flow control nozzle including means for attaching to a paint supply; and a plurality of arms, said arms extending laterally from said stand; and wherein said method comprises the steps of:

positioning said adjustable bank of nozzles in a substantially horizontal position;

positioning said arms to abut a wall adjacent to said ceiling;

attaching a paint supply to said flow control valve;

ensuring said first shutoff valve is shut;

activating said flow control valve such that paint sprays from said second bank of nozzles; and pushing said rollable stand such that paint is sprayed in a path across said ceiling.

7. A multiple nozzle paint spray apparatus, comprising:

(a) a first plurality of paint spray nozzles linearly positioned along a first support member that is oriented vertically;

(b) a second plurality of paint spray nozzles linearly positioned along a second support member that is adjustable between a vertical orientation and a horizontal orientation;

(c) paint supplying means for supplying paint to each said nozzle, wherein the flow of paint to the nozzles along said first support member is controllable independently of the flow of paint to the nozzles along said second support member;

(d) a rollable support stand, said stand supporting said first and second support members and said paint supplying means;

(e) a plurality of arms, said arms extending laterally from said stand; and (f) a plurality of flow brakes, a said one of said flow brakes placed in series between each said nozzle and said paint supply means.

8. An apparatus as recited in claim 7, wherein said paint supply means comprises:

(a) first and second tubing, said first tubing connected to and in fluid connection with said nozzles positioned along said first support member, said second tubing connected to and in fluid connection with said nozzles positioned along said second support member;

(b) a tee connector, said tee connector in fluid connection with said first tubing and said second tubing; and (c) a flow control valve in fluid connection with said tee connector, said flow control valve including means for attachment to a paint supply.

9. An apparatus as recited in claim 8, wherein said paint supplying means further comprises a pair of shut-off valves, first said shut-off valve located between said tee connector and said nozzles positioned along said first support member, second said shut-off valve located between said tee connector and said nozzles positioned along said second support member.

10. An apparatus as recited in claim 7, wherein said second support member includes means for swiveling said support member between said horizontal and vertical positions.

11. A multiple nozzle paint spray apparatus, comprising:

(a) a first plurality of spray nozzles positioned linearly along a first support member that is oriented vertically;

(b) a second plurality of spray nozzles positioned linearly along a second support member that is adjustable between a vertical orientation and a horizontal orientation;

(c) a plurality of flow brakes, each said flow brake positioned in series with a corresponding spray nozzle;

(d) paint supplying means for supplying paint to said nozzles, said flow brakes positioned between said nozzles and said paint supplying means, said paint supplying means including branch flow control means for independently controlling the flow of paint to said nozzles along said first support member and said nozzles along said second support member, respectively;

(e) a rollable support stand supporting said first and second support members and said paint supplying means; and (f) a plurality of arms, said arms extending laterally from said stand.

12. An apparatus as recited in claim 11, wherein said paint supplying means comprises:

(a) first and second tubing, said first tubing connected to and in fluid connection with said nozzles along said first support member, said second tubing connected to and in fluid connection with said nozzles along said second support member;

(b) a tee connector, said tee connector in fluid connection with said first tubing and said second tubing; and (c) a flow control valve in fluid connection with said tee connector, said flow control valve including means for attachment to a paint supply.

13. An apparatus as recited in claim 11, wherein said branch flow control means comprises first and second shut-off valves, said first shut-off valve located between said tee connector and said nozzles along said first support member, said second shut-off valve located between said tee connector and said nozzles along said second support member.

14. An apparatus as recited in claim 11, wherein said second support member includes means for swiveling said support member between said horizontal and vertical positions.

15. A multiple nozzle paint spray apparatus, comprising:

(a) a fixed position, vertically oriented linear bank of spray nozzles, a first tubing connected to and in fluid connection with said fixed bank of spray nozzles, and a first shutoff valve in fluid connection with said first tubing;

(b) a linear bank of spray nozzles adjustable between a vertical orientation and a horizontal orientation, a second tubing connected to and in fluid connection with said adjustable bank of spray nozzles, a second shutoff valve in fluid connection with said second tubing;

(c) said banks of spray nozzles supported by a rollable support stand;

(d) a plurality of flow brakes, said flow brakes placed in series between each said nozzle and said corresponding tubing;

(e) a tee connector, said tee connector in fluid connection with said first and second tubing;

(f) a flow control valve in fluid connection with said tee connector, said flow control nozzle including means for attaching to a paint supply; and (g) a plurality of arms, said arms extending laterally from said stand.

16. An apparatus as recited in claim 15, wherein said adjustable linear bank of nozzles includes means for swiveling said nozzles between said horizontal and vertical positions.

* * * * *